United States Patent [19]

Milam

[11] Patent Number: 4,542,681

[45] Date of Patent: Sep. 24, 1985

[54] MINE VENTILATION LINE CURTAIN EXTENDER

[76] Inventor: David W. Milam, Rte. 1, Box 160-A, Fayetteville, W. Va. 25840

[21] Appl. No.: 641,374

[22] Filed: Aug. 15, 1984

[51] Int. Cl.[4] ..... F17C 7/02

[52] U.S. Cl. ..... 98/50; 16/223; 160/123

[58] Field of Search ..... 98/50; 160/123; 126/140, 202; 16/223

[56] References Cited

U.S. PATENT DOCUMENTS

| | | | |
|---|---|---|---|
| 1,398,909 | 11/1921 | North | 98/50 |
| 2,395,689 | 2/1946 | Sembower, Jr. | 98/50 |
| 3,206,187 | 9/1965 | Cagley | 160/123 |
| 3,464,756 | 9/1969 | Burgess, Jr. | 98/50 |
| 3,747,503 | 7/1973 | Lovell | 98/50 |

FOREIGN PATENT DOCUMENTS

| | | | |
|---|---|---|---|
| 1107619 | 5/1961 | Fed. Rep. of Germany | 98/50 |
| 948292 | 1/1964 | United Kingdom | 98/50 |

*Primary Examiner*—Ronald C. Capossela
*Attorney, Agent, or Firm*—Harvey B. Jacobson

[57] ABSTRACT

A supporting structure by which the line curtain in a mine ventilation system can be extended in a cantilevered fashion from the last permanent roof support adjacent the working face of the mine so that the free edge of the extended line curtain will be adjacent the working face of the mine to assure that the face area where the mining is being done will be kept properly ventilated and free of dangerous gases and the like. In one embodiment of the invention which is especially adapted for use when mining high coal where the seam height is above 7 feet, an elongated extendible curtain support is pivotally supported from the last permanent roof support or roof bolt and is provided with a counterbalance weight projecting in a direction opposite to the curtain support with a drawstring structure being provided for extending the curtain support and thus the line curtain supported therefrom with the counterbalancing structure and the extending structure being accessible from an area adjacent the last mine roof bolt or permanent roof support. In another embodiment of the invention used when mining low coal where the seam height is from 3 to 7 feet, a leverage handle is provided to apply downward pressure on the curtain support on the side of the last roof bolt or permanent support opposite to the extendible curtain support thereby retaining the extendible curtain support adjacent the mine roof and supporting the line curtain extension in vertical position with the free edge thereof extending to a point adjacent the face area of the mine. In both embodiments of the line curtain extender, the operator of the mining machine controls is not hindered or blinded by the line curtain extension with the line curtain extension insuring movement of ventilating air past and around the mining machine, across the face area and around the free edge of the line curtain extension.

9 Claims, 11 Drawing Figures

90
96
92
40
30
38
54
94
20
34
52
48
5
5
56
98
28
26
36

90
88
CW
86
48
84
46
96
68
82
58
76
60
20
40
92
54
94
56
6
6

90
30
32
20
54
34
98
56
24
28
26

48'
112
112
110
108
106
118
114
104
96'
120
122
102
9
9
46'
60'
58'
54'
92
94'
52'
22
34'
56'

MINE VENTILATION LINE CURTAIN EXTENDER

BACKGROUND OF THE INVENTION

1. Field of the Invention

The present invention generally relates to a device installed in a mining tunnel where coal, rock and the like are being mined to facilitate ventilation of the face area of the mine by providing a line curtain extender to enable the line curtain to be extended beyond the last permanent roof support without personnel installing temporary supports for the line curtain beyond the last permanent roof support thereby eliminating personnel occupying a danger area and at the same time effectively supporting a line curtain extension so that it can be extended to comply with regulations with respect to spacing of the line curtain in relation to the face area of the mine without interference with operation of the mining machine or the visibility capabilities of the mining machine operator.

2. Description of the Prior Art

The following U.S. patents are relevant to this invention:

U.S. Pat. No. 750,829, Feb. 2, 1904
U.S. Pat. No. 1,257,535, Feb. 26, 1918
U.S. Pat. No. 1,465,334, Aug. 21, 1923
U.S. Pat. No. 1,486,120, Mar. 11, 1924
U.S. Pat. No. 3,464,756, Sept. 2, 1969
U.S. Pat. No. 3,715,969, Feb. 13, 1973
U.S. Pat. No. 4,180,352, Dec. 25, 1979

Of the above-listed patents, the patents to Burgess and Divers et al. relate to mine ventilation in which a movable line curtain is employed and explains the manner in which a line curtain is employed in the ventilation system of a mine. The other patents listed above disclose various counterbalanced support structures and the like. Burgess, U.S. Pat. No. 3,464,756, includes a line curtain extension that is supported by a spring biased roller similar to a window shade roller with the free edge of the curtain being connected with the mining machine. Burgess, U.S. Pat. No. 3,715,969, discloses an extendible line curtain supported by vertical members and a horizontal rod received between rollers to enable the curtain to be advanced toward the face area of the mine. The Divers et al. patent discloses a support system for a curtain including a channel-shaped mounting member which includes a track with the mounting member being displaceable by virtue of its connection with the support assemblies. While the prior patents disclose the basic concept of providing an extendible line curtain in a mine ventilation system, the structural features of the prior patents and their operational capabilities are not equivalent to the structures and operational capabilities of the present invention.

SUMMARY OF THE INVENTION

An object of the present invention is to provide a line curtain extender used in a mine ventilation system which enables the line curtain extension to be securely and independently supported and extended with the free edge thereof adjacent the face area of the mine without personnel proceeding past the last permanent roof support thereby eliminating personnel moving into more dangerous area of a mine tunnel in order to extend a line curtain so that it complies with safety regulations with proper placement of the line curtain extension assuring proper ventilation of the face area where the mining operation is taking place by removing dangerous gases and dust from the face area.

Another object of the invention is to provide a mine ventilation line curtain extender which is an elongated structure having a telescopic support for a line curtain extension that is supported from a hanger attached to the last permanent roof support and which can be pivoted in a vertical or horizontal plane and extended longitudinally by personnel disposed on the side of the last permanent roof support remote from the face area of the mine.

A further object of the invention is to provide a line curtain extender as set forth in the preceding objects in which the elongated support member is provided with a counter-balancing structure in the form of a counterbalancing weight and an operating mechanism to extend the curtain extension located to the side of the hanger remote from the face area of the mine with this arrangement being especially useful in high coal mining operations where substantial vertical height is available for movement of the counterbalancing structure.

Still another object of the invention is to provide a line curtain extender in accordance with the preceding objects in which the supporting member is provided with a leverage handle and a mechanism to operate the extendible and retractable line curtain extension support associated with the support member on the side of the hanger remote from the face area of the mine with the leverage handle being pivotally connected to the support member and engaged with the mine roof which is especially useful in low coal mining operations.

A still further object of the invention is to provide a mine ventilating line curtain extender in accordance with the preceding objects which is easily and safely installed, extended and manipulated from a position remote from the face area of the mine with the last permanent roof support oriented between the personnel operating the line curtain extender and the face area of the mine thereby eliminating the necessity of personnel proceeding into an area of the mine which does not have roof supports installed in order to provide temporary support for the line curtain extension.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
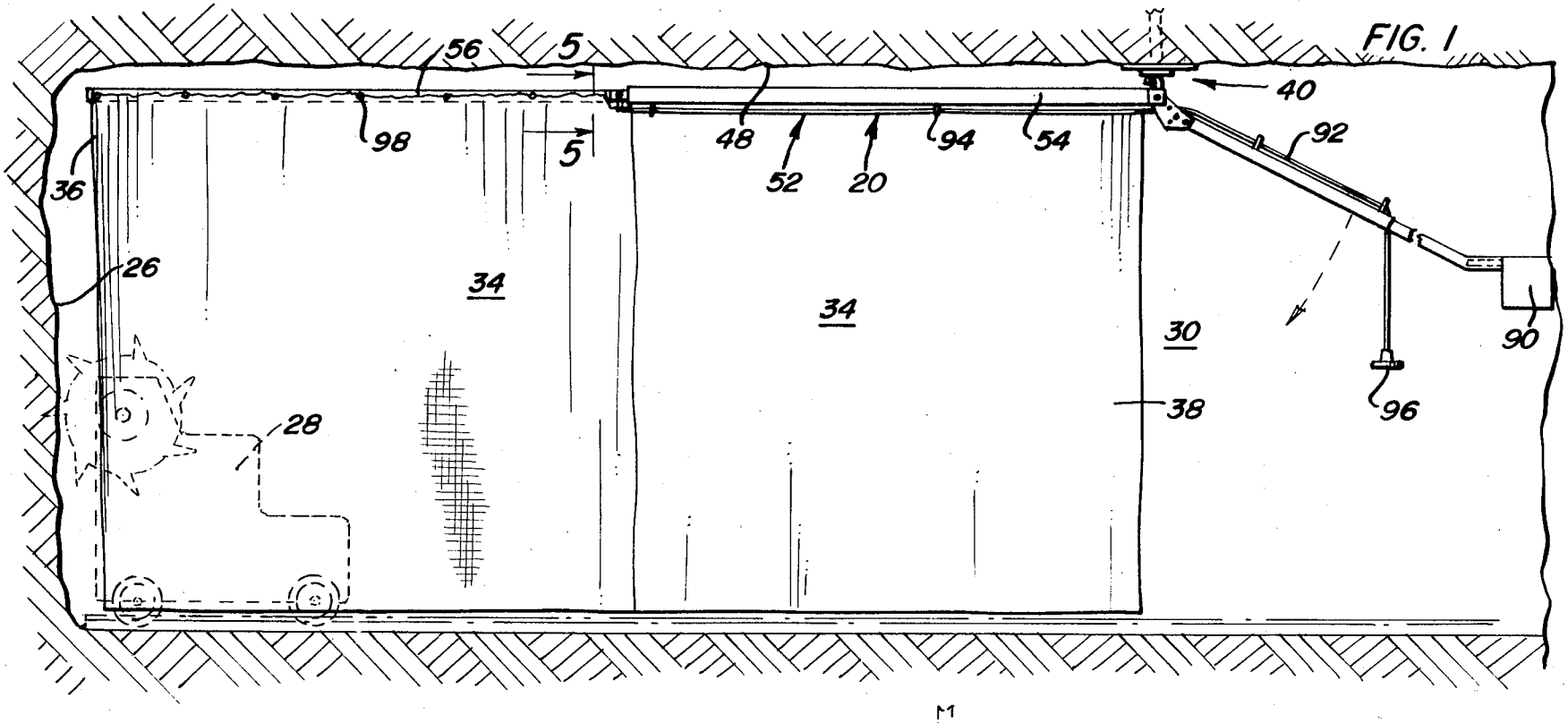
FIG. 1 is a side elevational view of the present invention illustrating the counterbalance weight embodiment in associated with a mining machine, face area and tunnel.
Figure 2:
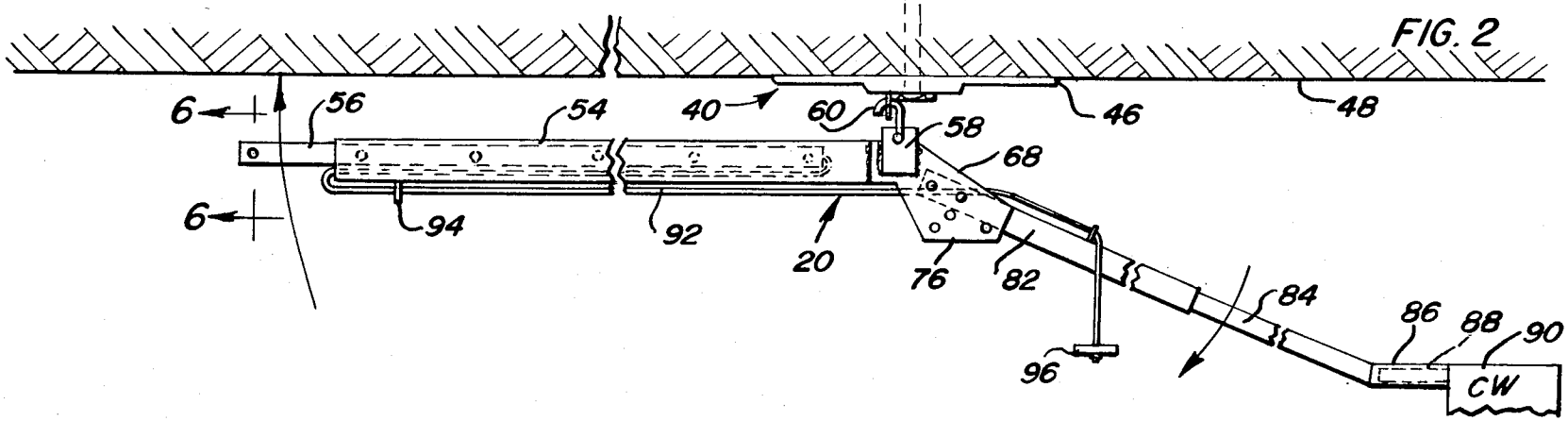
FIG. 2 is an enlarged elevational view of the extendible support for the line curtain extension.
Figure 3:
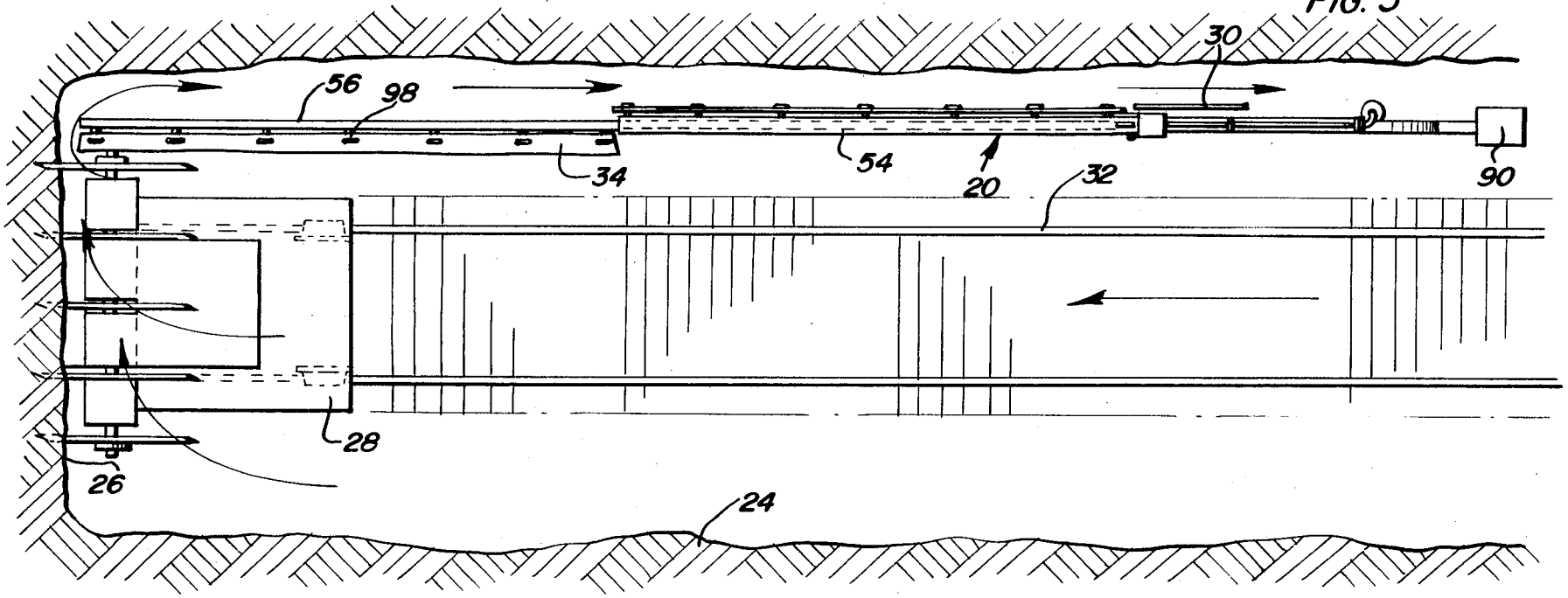
FIG. 3 is a schematic top plan view of the present invention further illustrating its association with the mine components.

Referring now specifically to the drawings, the mine ventilating line curtain extender illustrated in FIGS. 1–3 is generally designated by reference numeral 20 and is hereinafter defined as the counterbalanced embodiment of the invention for use with high coal where the seam height is over 7 feet. The embodiment of the invention illustrated in FIGS. 4 and 7–9 is generally designated by the numeral 22 and is hereinafter referred to as the leverage handle embodiment of the invention and is adapted for use in low coal where the seam height is between 3 feet and 7 feet. In both embodiments of the invention, the line curtain extender is installed in a mine tunnel 24 adjacent one side thereof and adjacent the face area 26 where the mining operation is being conducted by a mining machine 28 controlled by an operator (not shown). This type of mining operation is well known and is described in the prior art with a line curtain 30 being provided adjacent one wall of the mine tunnel so that ventilating air passes inwardly along the tunnel toward the face area 26 in the area which normally receives the rails 32 for mine cars and the like, around the end edge of the curtain 30 and then back between the curtain 30 and the sidewall of the tunnel in a manner well known and as illustrated by the arrows in FIG. 3. Since this technique is well known, it is not described in detail herein. In the present invention, a line curtain extension 34 is provided which has a vertical height generally equal to the remainder of the curtain and constructed of flexible material normally used in line curtains. The line curtain extension 34 has a height generally equal to the height of the tunnel although the same curtain can be used with both high and low coal so that the outer free edge 36 of the line curtain extension 34 will be disposed adjacent the face area 26 to comply with various safety regulations. The inner edge 38 of the line curtain extension 34 will overlap or be engaged with the line curtain 30 to provide a continuation thereof. The present invention relates to a structure for supporting the line curtain extension 34 from the last permanent roof support 40 in the form of a roof bolt 42 which is a conventional structure and includes a head 44 on the bolt 42 which retains a plate 46 against the mine roof 48 in a manner well known in the art with the plate including a circular rib 50 around the head 44 of the roof bolt 42. The structure of the roof bolt and the permanent roof support is conventional and one of the essential features of the present invention is the support of the line curtain extension 34 from the last permanent roof support so that personnel manipulating, extending and retracting the line curtain extension 34 will not proceed past the last permanent roof support toward the face area 26 thereby enabling such personnel to remain in a less hazardous area and eliminate the necessity of such personnel going beyond the last permanent roof support in order to install temporary supports for the line curtain as it is extended toward the face area 26 in order to comply with safety regulations and to assure proper ventilation of the face area where the mining operation occurs which, of course, creates dust and also may expose or open pockets of dangerous gases.

The line curtain extender 20 includes a supporting structure generally designated by numeral 52 which includes an elongated, rigid but lightweight hollow tube 54 of square or rectangular configuration. Telescopically slidable in the tube 54 is an extendible and retractable hollow tube 56 which is of similar but slightly smaller configuration to tube 54 so that the tube 56 can be extended to an extended position as illustrated in FIG. 1 or can be positioned in a retracted position as illustrated in FIG. 2. It is pointed out that the shape, size and configuration as well as the material from which the tubes 54 and 56 are constructed may vary so long as the weight of the line curtain extension supported from the hollow tubes can be effectively supported and the hollow tube 56 slide into and outwardly of the tube 54 with sufficient length of the tube 56 remaining in the tube 54 to retain the tubes 54 and 56 generally in horizontal alignment when extended. A suitable stop structure is provided between the tubes 54 and 56 to prevent the tube 56 from being extended too far out of the tube 54.

Figure 10:
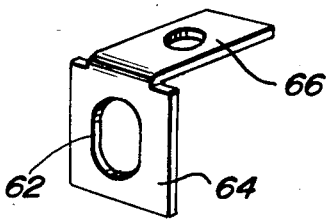
FIG. 10 is a perspective view of the hanger or clip attached to the mine roof bolt.
Figure 7:
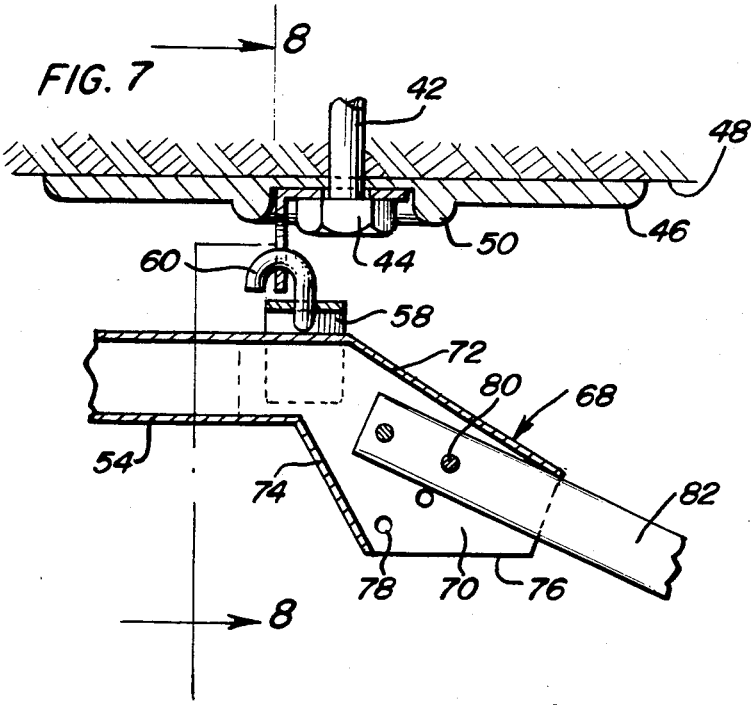
FIG. 7 is a fragmental sectional view of the supporting hanger and its associated structure for supporting the extender from the roof bolt forming the last permanent roof support.
Figure 8:
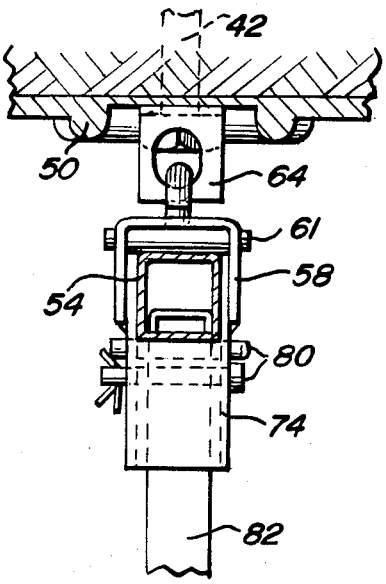
FIG. 8 is a sectional view taken substantially upon a plane passing along sectional line 8—8 on FIG. 7 illustrating further structural details of the supporting hanger structure.
Figure 9:
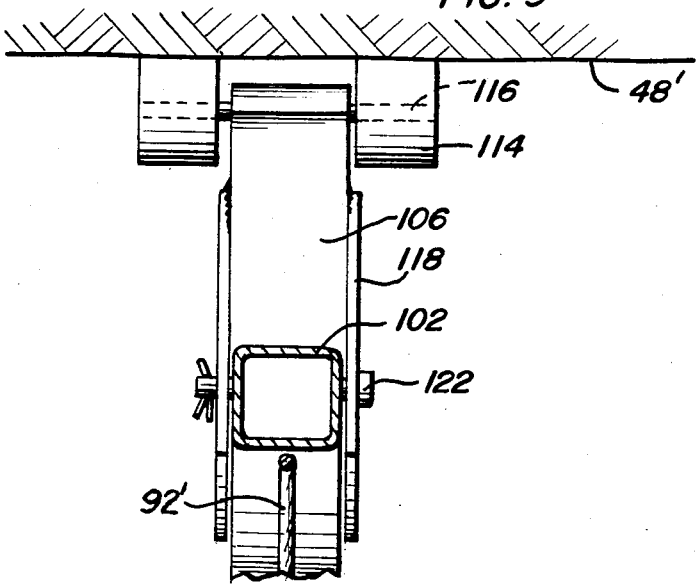
FIG. 9 is a detailed sectional view taken substantially upon a plane passing along section line 9—9 on FIG. 4 illustrating further structural details of the leverage handle embodiment of the invention and the manner in which the wheels on the end of the handle engage with the mine roof.
Figure 11:
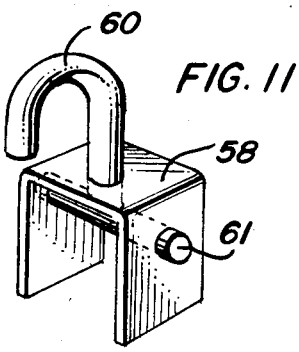
FIG. 11 is a perspective view of the hook structure connecting the extender to the hanger clip.

The end of the tube 54 remote from the end which receives the tube 56 is supported from the last permanent roof support 40 by a generally inverted U-shaped bracket 58 straddling and rigidly attached to the tube 56 in any suitable manner such as by welding, riveting, bolting or the like with the bracket 58 having a hook 60 attached thereto with the shank of the hook extending downwardly through the bight portion of the bracket 58 and terminating in a transverse rod 61 rigid therewith which extends through and is rigidly affixed to the legs of the bracket 58. The hook 60 is engaged with an aperture 62 in a hanger clip 64 illustrated in FIG. 10 which includes a tab 66 inserted under the head 44 of the roof bolt 42 thus securing the hanger clip 64 in position with the vertical component of the hanger clip 64 being retained by the peripheral rib 50 on the plate 46 as illustrated in FIG. 7. The semi-circular configuration of the upper end of the hook 60 retains the hook 60 engaged with the hanger 64 and yet permits swinging movement of the support structure 52 in a vertical plane and also in a horizontal plane to some extent due to the width of the aperture 62 being substantially greater than the diameter of the rod from which the hook 60 is made as illustrated in FIG. 8.

Attached to and forming a continuation of the hollow tube 54 is an angular extension 68 which includes opposite sidewalls 70, a top wall 72 and a bottom wall 74 with the top and bottom walls 72 and 74 diverging from each other and the sidewalls terminating in an angulated end edge 76. The sidewalls 70 are provided with a plurality of apertures or holes 78 for receiving attaching bolts 80 for adjustably connecting a square tube 82 therein in desired angular position. One of the bolts 80 extends through the end of the tube 82 and an inner hole 78 and a second bolt extends through the tube 82 and one of the holes 78 in the side plate 70 which are arcuately arranged about a center defined by the pivot bolt connecting the inner end of the tube 82 between the side plates 70 so that the angular relation of the tube 82 in relation to the extension 68 and thus tube 54 may be varied. A smaller tube 84 adjustably telescopes into the tube 82 and may be secured in adjusted position by a set screw or the like to vary the effective length of the tubes 82 and 84. The tube 84 includes a horizontal end portion 86 which slidably and detachably receives a projection 88 on a counterweight 90 so that the size of the counterweight 90 may be varied. A set screw may be used to secure the projection 88 in the hollow tube portion 86 if desired. Thus, with this construction, the weight of the counterweight 90 may be varied with the counterweight including the capability of merely adding additional weight thereon as the curtain extension 34 is extended to its full extent so that the weight of the counterweight 90 on one side of the pivot axis defined by the hook 60 will counterbalance the weight of the support 52 and the extended tube 56 and curtain 34 so that the support 52 and the upper edge of the curtain extension 34 will be retained adjacent the mine roof 48 regardless of the extended or retracted position of the curtain extension. With the curtain extension counterbalanced, personnel may easily lift up on or push down on the counterweight to move the curtain vertically and likewise move the counterweight and adjacent structure horizontally to swing the curtain in a lateral direction so that it can be optimally positioned with respect to the face area 26, mining machine 28 and tunnel structure.

Figure 6:
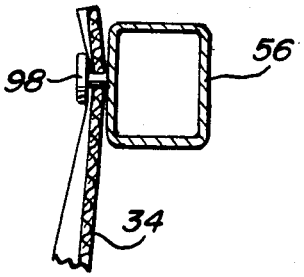
FIG. 6 is a transverse, sectional view taken substantially upon a plane passing along section line 6—6 on FIG. 2 illustrating the structure of the extendible support and the manner in which the line curtain extension is attached thereto.

A drawstring 92 extends along the under surface of the tube 54 and is guided by eyelets 94 with the drawstring extending around and into the end of the tube 54, along the tube 56 and anchored to the inner end of the tube 56. The drawstring 92 is guidingly associated with eyelets along the tube 54 and along the tube 82 and is provided with a handle 96 so that when the handle is pulled, the tube 56 will be extended. The number of eyelets may vary and the positioning of the drawstring may vary with the drawstring preferably being constructed of durable material such as steel cable or the like. As the mining operation proceeds and the support structure 52 is removed from one permanent roof support and moved to the next permanent roof support, the tube 56 may be manually retracted. Alternatively, a drawstring may extend to a suitable grommet in the top plate 72 and be attached to the inner end of the tube 56 and connected to the handle 96 forming a continuous drawstring to enable retraction of the tube 56 from the same point that the tube 56 can be extended if desired. Where the tube 56 receives the drawstring 92, a grooved roller may be provided or a low friction bearing surface may be provided similar to structures conventionally employed in draw drapes and the like. The curtain extension 34 may be secured to the tubes 54 and 56 by a bolt or any similar type fasteners as indicated by reference numeral 98 in FIG. 6 to provide a continuous curtain from a point adjacent the face area 26 for proper channeling of ventilating air. The tube 54 may be slotted to receive the supporting elements for the curtain 34 when tube 56 is retracted into the tube 54 in a manner similar to draw drapes and, as illustrated, the inner end of the tube 56 is provided with a tranverse rod 100 to which the drawstring 92 can be attached or if two drawstrings are used, both drawstrings can be attached thereto.

Figure 4:
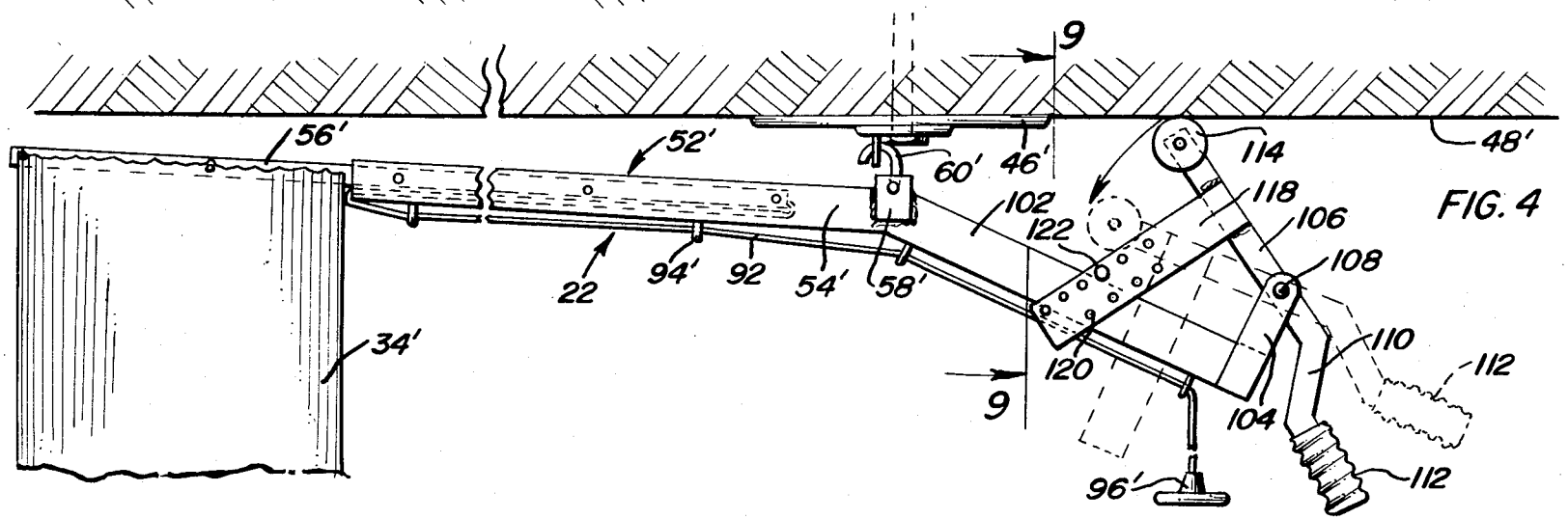
FIG. 4 is a side elevational view, with portions broken away, illustrating the embodiment of the invention utilizing a leverage handle to retain the supporting structure and curtain extension in adjacent relation to the mine roof.
Figure 5:
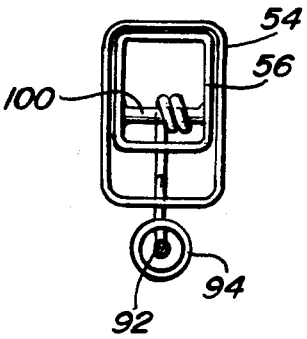
FIG. 5 is a transverse, sectional view taken substantially upon a plane passing along section line 5—5 on FIG. 1 illustrating the structural details of the extendible support.

The leverage handle embodiment of the present invention used in low coal has the same basic structure insofar as the curtain support is concerned and where the structure is identical, the same reference numerals are employed but primed. In this construction, the tube 54' is provided with an angulated extension 102 that may be a continuation of and rigid with the tube 54' with the tube 102 being downwardly angled as illustrated in FIG. 4 and including a pair of perpendicular brackets 104 at the terminal end thereof which extend upwardly in generally parallel relation to pivotally receive an elongated leverage handle 106 therebetween with the leverage handle 106 being pivotally supported from the upper ends of the brackets 104 by a pivot pin, bolt or the like 108. The end of the handle 106 which extends outwardly beyond the tube 102 is downwardly offset as at 110 and provided with a handgrip 112 on the terminal end thereof. The other end of the handle 106 is provided with a pair of rollers or wheels 114 mounted thereon and journalled on an axle or shaft 116 which extends through and is rigid with the end portion of the leverage handle 106 for engaging the roof 48' in a rolling manner.

Attached to and rigid with the portion of the handle 106 between the pivot pin 108 and the wheels 114 is a pair of elongated bracket straps 118 which are welded to the handle 106 and straddle the tube 102. The bracket straps 118 are provided with a plurality of aligned holes or apertures 120 therein for receiving a retaining pin 122 in the form of a keeper pin which may be inserted into one of a selected pair of apertures 120 with the pin engaging the upper surface of the tube 102 in order to secure the leverage handle 106 in adjusted position about the pivot pin 108. The pin 122 may be in the form of a headed bolt or headed pin with a securing member engaging the other end of the headed pin in order to removably secure the pin 122 in the selected pair of holes or apertures 120. As illustrated in FIG. 4, when the pin 122 is removed, the handle 106 can pivot in the manner illustrated by the arrow to the broken line position which is its inoperative position or its lowermost position and can be swung so that the rollers or wheels 114 come into contact with the mine roof 48' and exert downward pressure on the tube 102 thereby pivoting the support structure 52' in a vertical plane about an axis generally defined by the hook support 60'. This embodiment of the invention can also be swung laterally to move the curtin extension 34' toward and away from the sidewall of the mine tunnel if desired in order to orient it optimally in relation to the mining machine and operator so that the operation of the mining machine will not be hindered and visibility of the mining machine operator will not be hindered.

In view of the hazards encountered when mining, various laws and safety regulations have been enacted to reduce injuries and deaths by eliminating as many hazards as possible and reducing the number of personnel that are subjected to hazardous conditions. For example, safety laws require that no person is permitted to go beyond the last permanent roof support in underground mining except to set temporary roof supports in a potentially dangerous area until a permanent roof support can be installed. Setting temporary supports in the face area where the mining machine has taken coal out beyond 10 feet from the last permanent roof support is necessary in some instances to enable a worker to hang a ventilation line curtain from the temporary support thereby complying with the law or regulation that requires that the ventilating line curtain be kept within 10 feet of the deepest penetration point of the face area where the mining is being done in order to keep dangerous gases and dust out of the face area. Statistics indicate that a substantial percentage of injury and fatalities occur within 25 feet of the face area and approximately one-half of the fatalities occur when a worker goes beyond the last permanent roof support. With both forms of the present invention, the line curtain extension is extended 10 feet from the last permanent roof support. Then, when the mining operator has cleaned the face area up to the last permanent roof support, the line curtain extension can be left hanging in place to ventilate the face area until another permanent roof support and permanent line curtain 30 can be installed.

In most underground mines, a mining machine operator cannot advance more than 20 feet beyond the last permanent roof support because the controls used to operate the machine are set 20 feet from the end of the shearing or cutting wheel or wheels on the mining machine and the mining machine operator is not allowed to take the controls of the mining machine out from under the last permanent roof support. Thus, the present invention enables adequate ventilation to be provided and enables compliance with laws and regulations and eliminates the necessity of a worker installing a temporary support near the face area in order to hang a line curtain from it since the line curtain extension enables the line curtain to be extended to a point adjacent the face area and clearly within 10 feet of the face area. Also, the positioning of the line curtain extension enables the operator to observe the face area so that the mining operation is not hindered.

In each embodiment of the invention, the curtain rod or support structure is held tight against the mine roof so there will be no air loss due to the curtain sagging from its own weight. Also, coal seams or beds do not remain perfectly level as they go up and down grade. Curtain systems which operate like a shade roller move in a straight line and thus have a tendency to come off the bottom or the top and likewise when the curtain is attached to the mining machine, it has a blinding effect on the mining machine operator. With the present invention, the mine curtain extension is independent of the mining machine and can be moved from side to side thus enabling it to be moved away from the mining machine operator so as not to prevent him from having a clear view of the face area where the mining is being done. Also, the present invention is compatible with water and loose coal since water is provided to cool the electric motors in the continuous miners and law requires water spray systems to be installed in mines to control the dust wherever coal or rock is being mined. With the present invention, water and mud would be no problem since neither water or mud would inhibit the longitudinal telescopic movement of the tube 56. Also, there is no temporary support or jack in the way adjacent the face area of the mine to hinder operation of the mining machine with the present invention being very simple to install by merely hooking it to a hanger installed on the last permanent roof support. This facilitates quick and easy movement by only one worker who can either remove the counterweight or release the leverage handle and take the hook out of the hanger and move it to the next permanent roof support on which a hanger has already been hung.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mine ventilating line curtain extender for use in a mine tunnel having a working face and a line ventilating curtain terminating adjacent the permanent roof support closest to the working face, said extender comprising an elongated support structure, a line curtain extension suspended from said support structure generally in alignment with and forming an extension of the line ventilating curtain, means detachably, pivotally and swingably supporting the support structure adjacent one end thereof from the permanent roof support closest to the working face of the mine with the other end of the support structure extending in cantilever fashion toward the working face of the mine, said support structure including a pair of telescopic members with one of said members being supported from the permanent roof support and the other of said members being longitudinally extendable in relation to the supported member, said support structure including means adjacent the supported end thereof to extend the extendable member and the line curtain extension thereon and means adjacent the supported end thereof to retain the telescopic members adjacent the mine roof to enable the line curtain extension to be moved toward the working face and swung horizontally in the tunnel to optimum position in relation to the working face of the mine by an operator without the operator occupying the area between the permanent roof support closest to the working face and the working face of the mine.

2. The structure as defined in claim 1 wherein said telescopic members are elongated tubes with the larger of the tubes having one end portion supported from the permanent roof support and the smaller of the tubes being extended therefrom.

3. The structure as defined in claim 2 wherein said means supporting the support structure includes a hook rigidly mounted on the larger tube, and a hanger clip attached to the permanent roof support and including an aperture receiving the supporting hook to enable the tubes to be swung in a vertical plane, swung in a horizontal plane and easily detached from the hanger and attached to a hanger on a subsequently installed permanent roof support.

4. The structure as defined in claim 3 wherein a drawstring is provided along the length of the larger tube and extends inwardly of the free end of the larger tube remote from the hook and is connected to the inner end of the smaller tube to enable the smaller tube to be extended outwardly in relation to the larger tube.

5. The structure as defined in claim 1 wherein said means retaining the telescopic members adjacent the mine roof includes an extension on the supported telescopic member and extending to the opposite side of the point of support from the extendable telescopic member, and means on the extension for holding the telescopic members adjacent the mine roof.

6. The structure as defined in claim 5 wherein said means on the extension includes a removable counterweight to counterbalance the weight of the support structure and curtain extension on the opposite side of the point of support with the counterweight being interchangeable to vary the weight of the counterweight thereby varying the counterbalancing effect.

7. The structure as defined in claim 6 wherein the telescopic members are elongated tubes with the larger of the tubes having one end portion supported from the permanent roof support and the smaller of the tubes being extended therefrom.

8. The structure as defined in claim 5 wherein said means on the extension includes a leverage handle pivotally attached to the extension, wheel means on one end of the leverage handle for engagement with the mine roof, a handgrip on the opposite end of the handle for pivoting the handle about a transverse axis, and adjustable means interconnecting the handle and extension to retain the handle in desired angular relation in relation to the extension to retain the wheel means on the handle in engagement with the mine roof thereby adjustably retaining the telescopic members adjacent the mine roof.

9. The structure as defined in claim 8 wherein said telescopic members are elongated tubes with the larger of the tubes having one end portion supported from the permanent roof support and the smaller of the tubes being extended therefrom.

* * * * *